US009297615B2

(12) United States Patent
Meinert et al.

(10) Patent No.: US 9,297,615 B2
(45) Date of Patent: Mar. 29, 2016

(54) MULTIPLE-ZERO-POINT RIFLESCOPE TURRET SYSTEM

(71) Applicant: Alliant Techsystems Inc., Minneapolis, MN (US)

(72) Inventors: Robert J. Meinert, Andover, MN (US); William Atwood, Coon Rapids, MN (US); Thomas Kramer, Blaine, MN (US); Brent R. Cook, Blaine, MN (US)

(73) Assignee: VISTA OUTDOOR OPERATIONS LLC, Clearfield, UT (US)

( * ) Notice: Subject to any disclaimer, the term of this patent is extended or adjusted under 35 U.S.C. 154(b) by 0 days.

(21) Appl. No.: 14/216,047

(22) Filed: Mar. 17, 2014

(65) Prior Publication Data

US 2014/0319216 A1 Oct. 30, 2014

Related U.S. Application Data

(60) Provisional application No. 61/800,495, filed on Mar. 15, 2013.

(51) Int. Cl.

| | |
|---|---|
| ***G06K 19/00*** | (2006.01) |
| ***F41G 1/387*** | (2006.01) |
| ***F41G 1/38*** | (2006.01) |
| ***F41G 1/18*** | (2006.01) |

(52) U.S. Cl.
CPC *F41G 1/387* (2013.01); *F41G 1/18* (2013.01); *F41G 1/38* (2013.01)

(58) Field of Classification Search
USPC ..... 235/400–418
See application file for complete search history.

(56) References Cited

U.S. PATENT DOCUMENTS

| | | | |
|---|---|---|---|
| 3,280,463 | A | 10/1966 | Stadler |
| 3,990,155 | A | 11/1976 | Akin, Jr. et al. |
| 4,392,723 | A | 7/1983 | Gehmann |
| 4,806,007 | A | 2/1989 | Bindon |
| 5,557,871 | A | 9/1996 | LaLonde |
| 5,715,607 | A | 2/1998 | Murg |
| 6,279,259 | B1 | 8/2001 | Otteman |
| 6,643,970 | B2 | 11/2003 | Huber |
| 6,772,550 | B1 | 8/2004 | Leatherwood |
| 7,185,455 | B2 | 3/2007 | Zaderey |

(Continued)

FOREIGN PATENT DOCUMENTS

| | | |
|---|---|---|
| DE | 30 04 635 A1 | 8/1981 |
| WO | WO 97/37193 A1 | 10/1997 |

(Continued)

OTHER PUBLICATIONS

"Leupold & Stevens VXR 4-12×50mm Ballistic Firedot Illuminated Riflescope—Matte", retrieved from internet on Feb. 21, 2014 (2 pgs.).

(Continued)

*Primary Examiner* — Matthew Mikels
(74) *Attorney, Agent, or Firm* — Christensen Fonder P.A.

(57) ABSTRACT

A riflescope aiming system that includes a telescopic sight, a multiple-zero-point elevation turret and an aiming reference system. The multiple-zero-point elevation turret includes a rotatable indicator carrier and a plurality of indicator pins secured to the indicator carrier, each indicator pin corresponding to a predetermined target distance. The aiming reference system is operably coupled to the objective housing of the telescopic sight and displays aiming reference data.

18 Claims, 10 Drawing Sheets

(56) References Cited

U.S. PATENT DOCUMENTS

| | | | |
|---|---|---|---|
| 7,581,346 | B2 | 9/2009 | Klepp et al. |
| 7,584,570 | B2 | 9/2009 | Smith |
| 7,624,526 | B2 | 12/2009 | Paasikivi et al. |
| 7,827,723 | B1 | 11/2010 | Zaderey et al. |
| 7,832,137 | B2 | 11/2010 | Sammut et al. |
| 7,905,046 | B2 | 3/2011 | Smith, III |
| 7,913,440 | B2 | 3/2011 | Murg et al. |
| 7,946,073 | B1 | 5/2011 | Buck |
| 8,091,268 | B2 | 1/2012 | York |
| 8,166,696 | B2 | 5/2012 | Hamilton |
| 8,166,697 | B1 | 5/2012 | Sueskind |
| 8,230,635 | B2 | 7/2012 | Sammut et al. |
| 8,286,383 | B2 | 10/2012 | Matthews |
| 8,286,384 | B2 | 10/2012 | Zaderey et al. |
| 8,353,454 | B2 | 1/2013 | Sammut et al. |
| 8,397,420 | B2 | 3/2013 | Hamilton |
| 2002/0078616 | A1 | 6/2002 | Perry et al. |
| 2002/0159148 | A1 | 10/2002 | Huber |
| 2004/0144013 | A1 | 7/2004 | Leatherwood |
| 2005/0229468 | A1 | 10/2005 | Zaderey et al. |
| 2005/0257414 | A1 | 11/2005 | Zaderey et al. |
| 2007/0240356 | A1 | 10/2007 | Klepp et al. |
| 2008/0066364 | A1 | 3/2008 | Klepp et al. |
| 2008/0289239 | A1 | 11/2008 | Menges et al. |
| 2009/0049733 | A1 | 2/2009 | Matthews |
| 2010/0229451 | A1* | 9/2010 | Hamilton ..... 42/126 |
| 2012/0113507 | A1 | 5/2012 | Arai |
| 2012/0137567 | A1 | 6/2012 | Sammut |
| 2013/0014421 | A1 | 1/2013 | Sammut et al. |
| 2013/0170027 | A1 | 7/2013 | Peters et al. |
| 2013/0276345 | A1 | 10/2013 | Hamilton |
| 2013/0286472 | A1 | 10/2013 | Arai et al. |
| 2014/0000146 | A1 | 1/2014 | Davidson |

FOREIGN PATENT DOCUMENTS

| | | | |
|---|---|---|---|
| WO | WO 99/30101 | A1 | 6/1999 |
| WO | WO 2006/003265 | A1 | 1/2006 |
| WO | WO 2006/017868 | A1 | 2/2006 |
| WO | WO 2006/017869 | A1 | 2/2006 |
| WO | WO 2013/106280 | A1 | 7/2013 |

OTHER PUBLICATIONS

"E. Arthur Brow Company On-Line Shopping Cart," http://www.eabco.com/Reports/report0.html, retrieved from the internet on Feb. 21, 2014 (5 pgs.).

"Redfield/Revolution™ & Revolution/TAC™ Product Brochure," retrieved from the internet on Feb. 22, 2014 (14 pgs.).

"2009 BARSKA Sports Optics Catalog/Riflescopes," retrieved from the internet on Feb. 21, 2014 (29 pgs.).

* cited by examiner

MULTIPLE-ZERO-POINT RIFLESCOPE TURRET SYSTEM

PRIORITY CLAIM

The present application claims the benefit of U.S. Provisional Application No. 61/800,495 filed Mar. 15, 2013, which is incorporated herein by reference in its entirety.

FIELD OF THE INVENTION

The present invention is directed generally to a riflescope. Specifically, the present invention is directed to a riflescope with a multiple-zero-point turret with adjustable distance indicia, and a system for easily determining turret indicia set-points based on user-inputted ammunition, rifle, and atmospheric characteristics.

BACKGROUND

Many firearms, such as rifles, are equipped with optical sights, which use optics that provide the user with an image of an aligned aiming point or pattern (commonly known as a reticle) superimposed at the same focus as the target.

When shooting at long distances, shooters must adjust their aim to take into account the downward acceleration on the projectile imparted by gravity, which often referred to as "bullet drop." This is typically done by adjusting the angular position of the riflescope relative to the rifle barrel using an elevation turret.

A zero point for a riflescope is determined when "sighting" a rifle at a known distance by adjusting the angular position of the riflescope relative to the rifle barrel, via the elevation turret, until the impact point of the bullet matches the point on the target coincident with the optical center of the riflescope reticle. For targets at greater distances than the distance used for establishing the riflescope's zero point, the elevation turret is used to adjust the angular position of the scope with respect to the rifle barrel to compensate for the greater amount of bullet drop.

The vast majority of hunting riflescopes have a single elevation zero point that is set to a single distance or elevation, e.g., 100 yards. Unless the riflescope's turret can be adjusted to match further distances beyond a single zero point, it is impossible to accurately and swiftly predict where a bullet will impact at middle to long distances without additional rapid adjustment aids.

Recently, riflescopes have been developed that include a turret with multiple indicators that each represent a zero point for various distances and scope elevation settings. Thus, a shooter can select an index indicator that corresponds to the distance of his target to adjust his riflescope to the proper elevation. One example of this type of riflescope is disclosed in U.S. patent application Ser. No. 12/068,098 to Menges et al. (hereinafter referred to as Menges). Menges discloses a riflescope turret with an inner coupling device surrounded by annular stacking indexing elements. Since the indexing elements stack on top of one another, the number of indexing elements that can be used is limited by their thickness with respect to the height of the coupler. As disclosed, a maximum of four indexing elements can be used, which limits resolution and accuracy potential. The number of available zero points or stops corresponds to the turret's elevation resolution; therefore, fewer zero points correspond to larger distances between zero points, which in turn results in a larger margin of error for distances between zero points. For example, if a shooter wanted to calibrate his riflescope for a range of 100 to 500 yards and had three available zero points, he could set the zero stops at 100, 300, and 500 yards, respectively. However, if five zero stops were available, he could set them at 100, 200, 300, 400, and 500 yards, respectively. In practice, for example, a target at 400 yards would be perfectly sighted for the system with five zero points, whereas the shooter with the three zero point system would have to set the turret at 300 yards and make manual adjustments to compensate for the remaining 100 yards.

A further limitation of modern riflescopes with multiple zero points, including Menges, is a limited rotational range of the turret, which affects turret range and/or resolution. The rotational range of a turret may be expressed in "minutes of angle" or MOA. Rotating the turret adjusts the angular position of the riflescope relative to the rifle barrel. The greater the target distance, the more MOA the turret must be rotated to compensate for the greater amount of bullet drop. The Menges turret has twelve MOA per 360° of rotation of the turret and the turret is limited to one turn, therefore limiting the range and/or resolution of the turret.

An even further limitation with modern riflescopes, including Menges, is the perceptibility of the indicators. Since each indicator zero point corresponds to a specific rotational angle of the turret, the width of the indicator zero point is limited by the arc length of the MOA resolution, and by the height of the indicator index. Riflescopes such as Mendes that use annular indicator indexes necessarily have very small indicator zero points, which are in the form of small colored dots, because the height of each annular index is limited by the overall turret height and the number of additional indices. Thus, it would be preferable to utilize index indicators that are as wide as the arc length of the turret's MOA resolution, and that are each as tall as the entire visible height of the turret.

An additional problem with current riflescopes is caused by the myriad distinctions between individual characteristics of ammunition, rifles, and atmospheric conditions. Ammunition and rifles each vary by brand and even by model within a given brand with respect to shot characteristics and manufacturing tolerances. Likewise, atmospheric conditions significantly vary depending on geographic location. For example, rifles used in northern Minnesota are subject to very different atmospheric conditions than those used in Afghanistan. In aggregate, there are countless possible combinations of parameters that have a direct effect on a given rifle's accuracy at various ranges.

SUMMARY

It is an object of the present invention to provide a riflescope with an adjustment and aiming system that can be easily setup, tested, and tuned to match a bullet's point of impact at various ranges for a specific gun, ammunition, and atmosphere combination.

It is a further object of the present invention to provide a calculation tool that indicates riflescope elevation and windage setup parameters based on shooter-inputted firearm, ammunition, and atmospheric combinations.

It is an even further object of the present invention to provide a riflescope with a turret having multiple elevation zero-point adjustments, in which a user can easily set indicator indices for a plurality of elevation zero points based on the output of the calculation tool. Additionally, it is desired that the indicator indices are easily perceptible by maximizing the height dimension of each indicator index.

It is a yet even further object of the present invention to provide a quick reference disc within a lens cover on the riflescope to aid the shooter in easily selecting the right turret stop for multiple known distances, wherein the reference disk is automatically generated by the calculation tool for the shooter's given setup.

In an embodiment, the claimed invention comprises a riflescope turret indicia system having a plurality of colored indicator pins located around a center splined indicator carrier, which is removable from the scope and retained by a gripping cap and screw. Each indicator pin represents a zero point for a given elevation distance. The indicator carrier includes a plurality of indicator-pin channels formed around the circumference of the indicator carrier for receiving a plurality of indicator pins. Each of the indicator-pin channels, in an embodiment, represents a specific angular position, which may be a minute of angle (MOA) position.

In an embodiment, an electronic tool, such as a ballistics calculator, allows a user to input various parameters of the riflescope setup, rifle, ammunition, and anticipated atmospheric conditions, and automatically provides the indicator carrier MOA position for each of the plurality of colored indicator pins.

Once the colored indicator pins have been positioned for the specific conditions, a method of operation is as follows: First, the shooter estimates the distance to the target, which may include using a laser sight or other distance-measuring means. Next, the shooter checks the ballistic reference disc on the lens cover, which will indicate the color of the indicator pin for the specific distance, as well as the reticle wind hold. After that, the shooter rotates the indicator carrier until the appropriately-colored indicator pin is aligned with the zero point marker. Next, the shooter aims, correcting for the reticle wind hold. Finally, the shooter fires his rifle at the target.

BRIEF DESCRIPTION OF THE DRAWINGS

The invention can be completely understood inconsideration of the following detailed description of various embodiments of the invention in connection with the accompanying drawings, in which.

Figure 1:
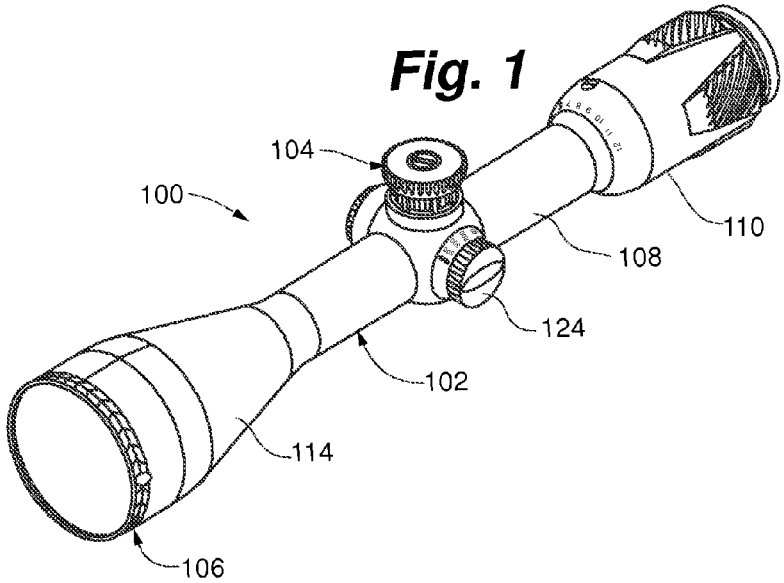
FIG. 1 is front, perspective view of a riflescope aiming system, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Embodiments of the claimed invention described herein generally include an ergonomic, easy-to-use riflescope aiming system ideally suited for mid- to long-range shooting. Embodiments include an adjustable, multiple-zero-point elevation turret having highly visible zero-stop indicators, which in an embodiment may be color coded for quick reference. Additional embodiments of the claimed invention also include an aiming reference system providing multiple distance and windage data sets corresponding to the multiple-zero-point elevation turret system and corresponding to an indexed wind-hold reticle.

Referring to FIGS. 1-4, riflescope aiming system 100, according to an embodiment of the claimed invention, comprises telescopic sight 102, multiple-zero-point elevation turret 104 and aiming reference system 106. Riflescope system 100 is described herein in the context of usage with rifles. It will be understood, however, that riflescope system 100 may be used individually or in combination with other firearms, including shotguns, handguns, bows, or various other types of firearms and weapons.

Figure 14:
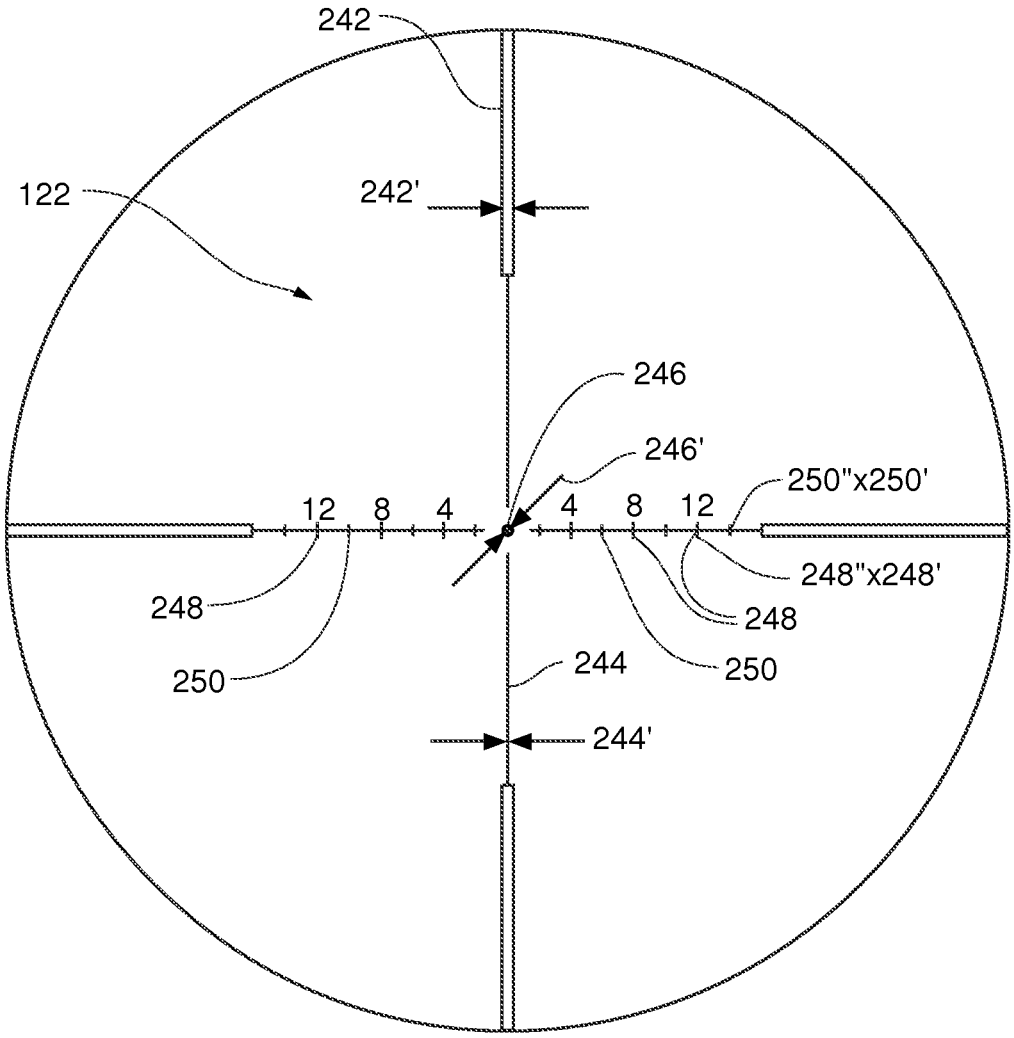
FIG. 14 is depiction of an indexed reticle pattern, according to an embodiment of the claimed invention.

Telescopic sight 102 includes generally cylindrical body 108, ocular housing 110 carrying ocular lens system 112, objective housing 114 carrying an objective lens system 116, and erector assembly 118 with reticle cell 120 having reticle pattern 122 (see also FIG. 14). In an embodiment, telescopic sight 102 may also include windage adjustment turret 124.

Ocular housing 110 is positioned at a first end of cylindrical body 108, while objective housing 114 is positioned at a second end of cylindrical body 108.

Multiple-zero-point elevation turret 104 is mounted to cylindrical body 108 and is rotatable about axis A. Multiple-zero-point elevation turret 104 is described in further detail below with respect to FIGS. 5-10.

Aiming reference system 106, in an embodiment, is coupled to objective housing 141. In an embodiment, aiming reference system 106 comprises a disc with printed indicia connected to objective housing 114. Aiming reference system 106 is described in further detail below with respect to FIGS. 11-14.

The details of standard optical lens systems of telescopic sights for firearms are generally well known in the art, having been described in many patents, including patents such as U.S. Pat. No. 4,806,007, Issued Feb. 21, 1989 and entitled OPTICAL GUN SITE, and U.S. Pat. No. 7,913,440, issued Mar. 29, 2011, and entitled TELESCOPIC SIGHT, U.S. Pat. No. 8,286,383, both of which are herein incorporated by reference in their entireties. As such, standard optical systems and features of telescopic sights are generally well known, such features will not be discussed in detail herein.

Figure 5:
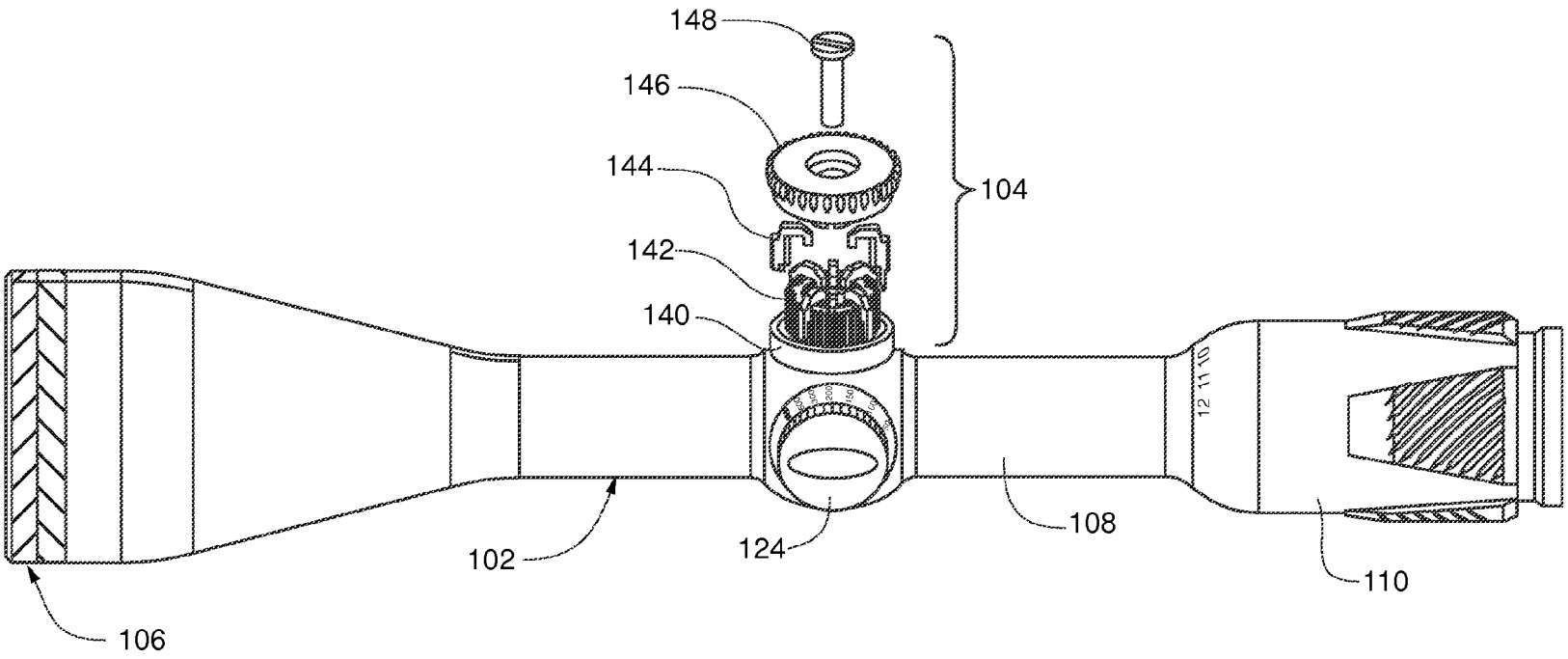
FIG. 5 is a right-side perspective view of the riflescope aiming system of FIG. 1, depicting a multiple-zero-point elevation turret in an exploded view, according to an embodiment of the claimed invention.

Referring to FIG. 5, multiple-zero-point elevation turret 104, according to an embodiment, generally comprises a turret base 140 fixably coupled to cylindrical body 108 of telescopic sight 102, an indicator carrier 142, a plurality of indicator pins 144, gripping cap 146, and cap fastener 148.

According to an embodiment, each of the components of the multiple-zero-point elevation turret 104 may be constructed of a machined metal, such as aluminum, steel, or various alloys, or alternatively, a cast metal or an injection molded polymer. Furthermore, the components could be anodized or otherwise coated to provide enhanced durability. The components of multiple-zero-point elevation turret 104, according to an embodiment, may further include various features or surface treatments to ease assembly. For example, the outer circumference of gripping cap 146 may be knurled to provide better grip while being screwed down.

Figure 6:
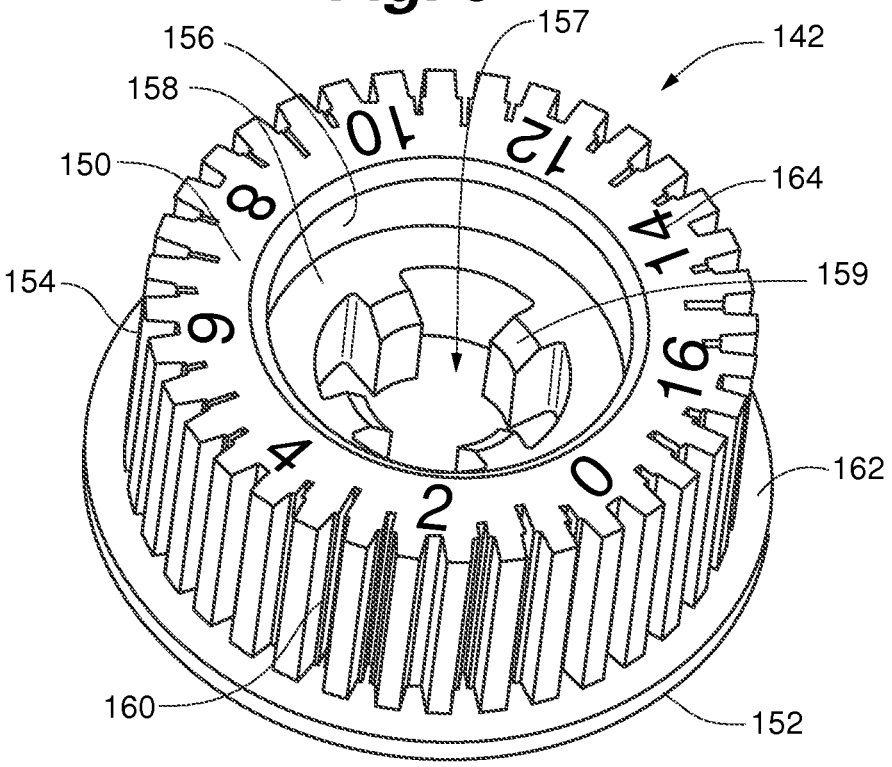
FIG. 6 is a perspective view of an indicator carrier of the multiple-zero-point elevation turret of FIG. 5, according to an embodiment of the claimed invention.
Figure 7:
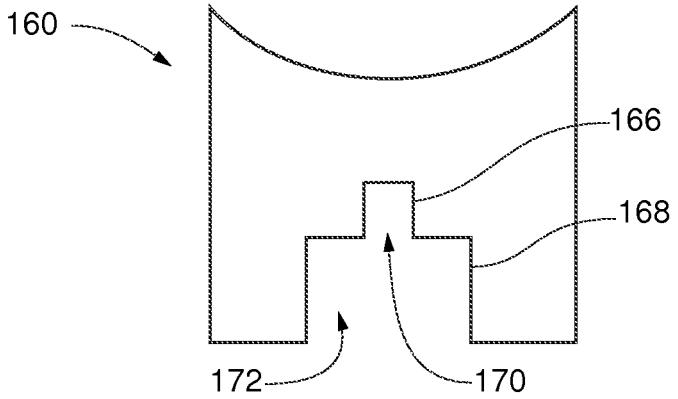
FIG. 7 is a top view of a portion of the indicator carrier of FIG. 7, depicting an indicator-pin channel, according to an embodiment of the claimed invention.

Referring also to FIGS. 6-7 an embodiment of indicator carrier 142 is depicted. In an embodiment, indicator carrier 142 is substantially cylindrical, and includes top surface 150, bottom surface 152, outer surface 154 and inner surface 156. In an embodiment, inner surface 156 defines central aperture 157. Projections 159 protrude radially inward toward the center of carrier 142, such that central aperture 157 comprises a splined aperture. In an embodiment, central aperture 157 is configured to engage with an end of spindle 119 projecting axially upward through central aperture 157.

A plurality of indicator-pin channels 160 are spaced evenly about the outer circumference of indicator carrier 142 and extend radially inward from the outer surface 154, and axially downward from surface 150. Additionally, base 162 extends radially from bottom surface 152 of indicator carrier 142, extending slightly past the outer edge of the wide walls 168 of the indicator-pin channels 160 and creating a flange.

Referring specifically to FIG. 7, a portion of indicator carrier 142 defining indicator-pin channel 160, as shown from a top view, according to an embodiment of the invention, is depicted and described in further detail.

Each of the plurality of indicator-pin channels 160 is configured to receive any one of the plurality of indicator pins 144. Indicator-pin channel 160 includes narrow walls 166 and wide walls 168, which define a narrow slot 170 and a wide slot 62, respectively. The narrow slot 60 and wide slot 172 engage with complementary features on an indicator pin 144, to retain the pin. Each of the narrow slots 170 correspond to a respective angular position or MOA position on indicator carrier 142. Referring again to FIG. 6, a plurality of angular position indicia, or MOA labels or indicia 164, are disposed circumferentially on top surface 150 of the indicator carrier 142. Each MOA label 164 is aligned with a narrow slot 170 of an indicator-pin channel 160. The MOA labels 164 can be machined, etched, painted, or otherwise affixed to the indicator carrier 142. When an indicator pin 144 is seated in an indicator-pin channel 160 of the indicator carrier 142, the center of the indicator pin 144 is aligned with the center of its indicator-pin channel 160, and therefore is aligned with the center of that particular angular position indicium.

The angular position resolution of indicator carrier 142 is dictated by the number of indicator-pin channels 160 on the indicator carrier 142. For each indicator carrier 142, a complete 360° rotation corresponds to a given MOA value, which in this example embodiment happens to be 18 MOA. Depending on the number of indicator-pin channels 160, each channel can represent one unit, such as one MOA, or a fraction or multiple thereof. In the example embodiment, each indicator-pin channel 160 represents 0.5 MOA.

Figure 8:
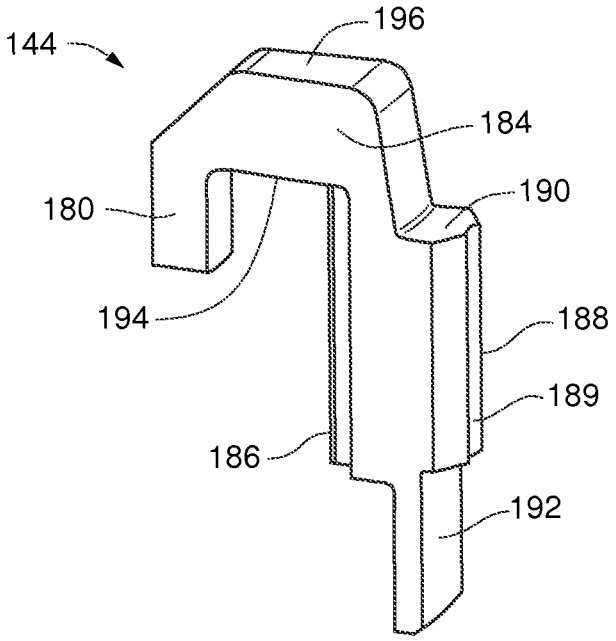
FIG. 8 is a perspective view of an indicator pin, according to an embodiment of the claimed invention.
Figure 9:
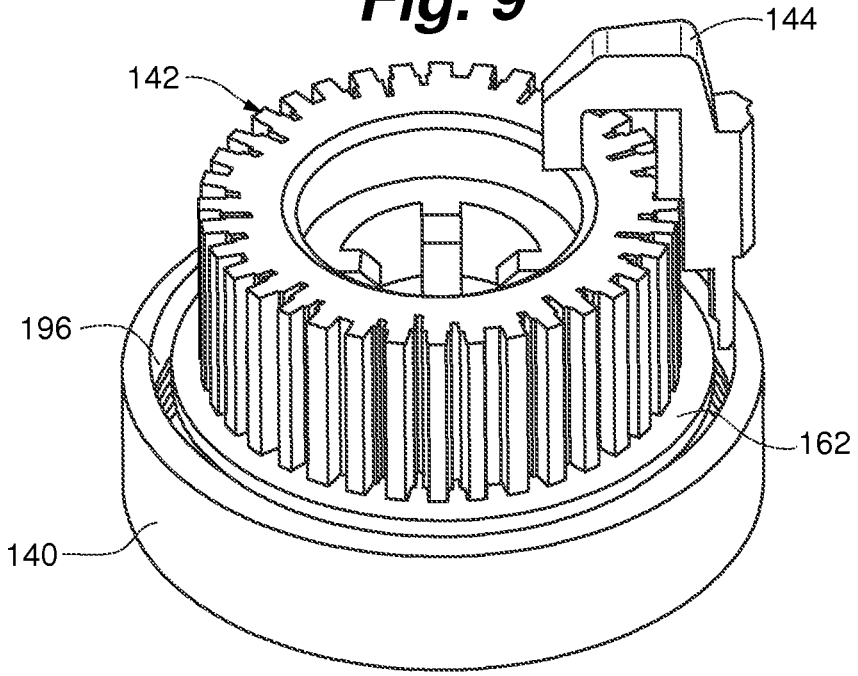
FIG. 9 is a perspective view of an indicator pin positioned on the indicator carrier, according to an embodiment of the claimed invention.

Referring now to FIG. 8, an indicator pin 144, according to an embodiment of the invention, will be described. Indicator pin 144, according to an embodiment, comprises a unitary body generally shaped like an upside down letter "J". Indicator pin 144 generally has inner hook section 180, outer leg section 182, and top neck section 184 that connects inner hook section 180 to outer leg section 182. Inner hook section 180 and outer leg section 182 define inner and outer directions for the purposes of describing indicator pin 144. The width of indicator pin 144 converges, with the width at its outer-most section being thickest to the width at its inner-most section being thinnest, such that multiple indicator pins 144 can be placed adjacent each other on the indicator carrier 142.

Extending inwards from the outer leg section 182 is the pin key section 186, which correspondingly fits into a pin channel 160 of the indicator carrier 142. Extending outward from the central portion of outer leg section 182 is the visual index portion 188, which presents index surface 189 which is visible to a user. In an embodiment, visual index portion 188 is easily visible to a user because it is the widest section of the indicator pin 144. The top of the visual index portion 188 defines a retaining shelf 190, which gripping cap 146 depresses. Opposite shelf 190 at the bottom-most portion of outer leg section 182 is finger section 192, which slidably engages with channel 196, which is defined by indicator carrier base 162 and turret base 140.

Top neck section 184 includes bottom face 194, which slidably engages with top surface 150 of indicator carrier 142, and top face 196, which gripping cap 146 depresses. Furthermore, in an embodiment, the edges of the visual index portion 188 are chamfered and the center is indented, making it easy to determine the center of the pin to ensure that it is properly aligned with zero-index mark or "zero indicator" 200 of FIG. 10 during operation.

Figure 10:
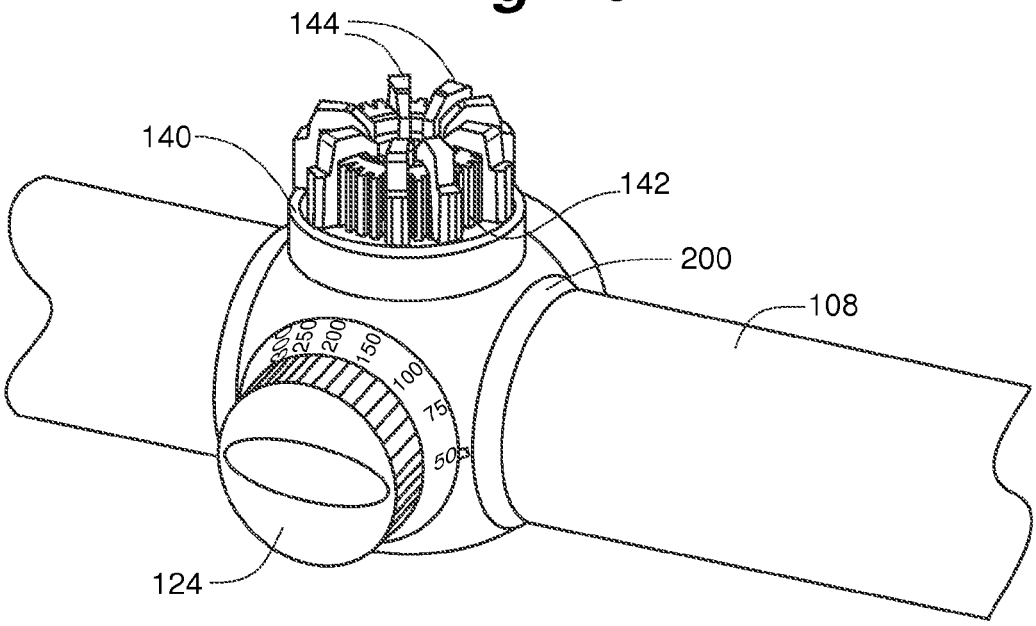
FIG. 10 is a perspective view of the multiple-zero-point elevation turret of FIG. 5 with a gripping cap removed, the turret mounted to a telescopic scope.

Referring to FIG. 10, indicator carrier 142 with multiple indicator pins 144 is depicted as received by turret base 140. As will be described further below, each indicator pin 144 when properly located, corresponds to a predetermined target distance.

Figure 2:
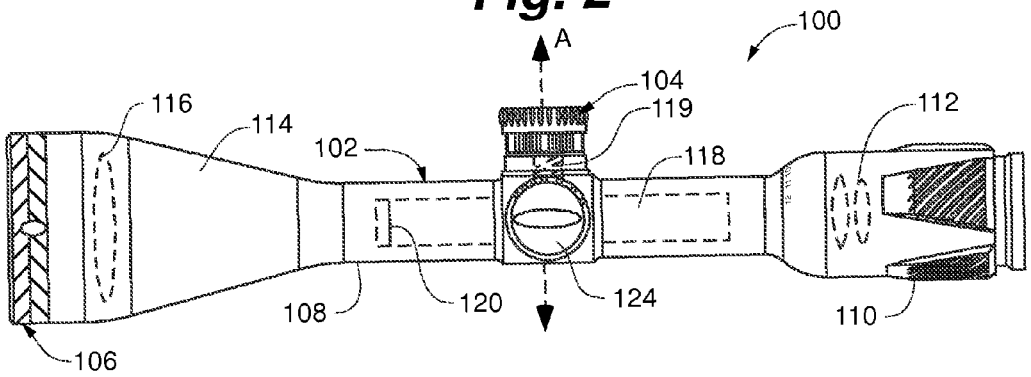
FIG. 2 is a right-side view of the riflescope aiming system of FIG. 1.
Figure 3:
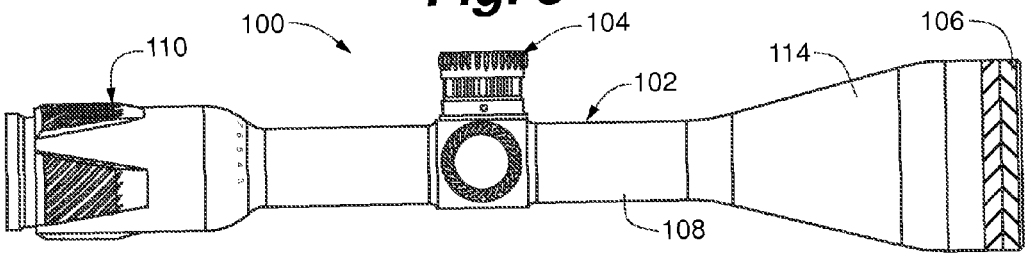
FIG. 3 is a left-side view of the riflescope aiming system of FIG. 1.
Figure 4:
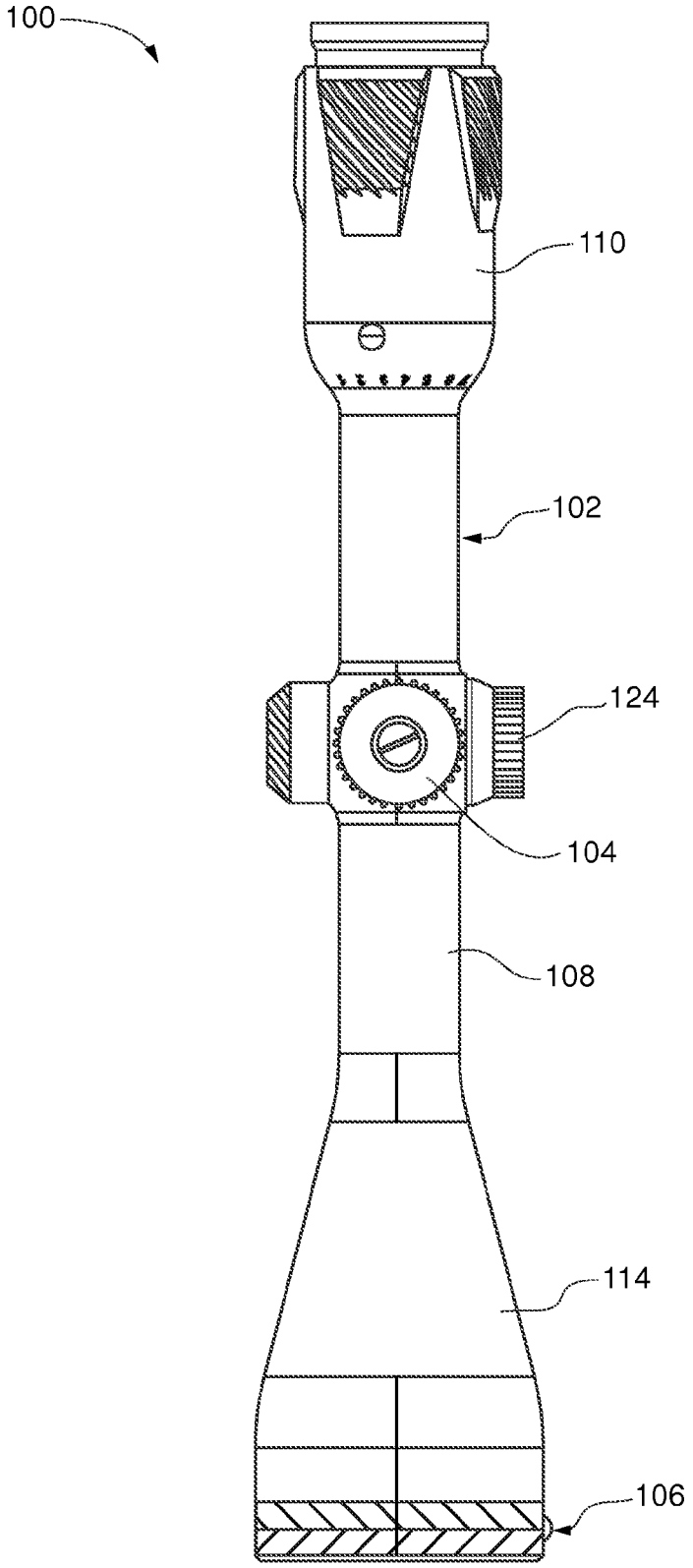
FIG. 4 is a top view of the riflescope aiming system of FIG. 1.

In an embodiment, turret base 140 includes a shallow recess configured to receive base 162 of indicator carrier 142. In an embodiment, turret base 140 also includes an aperture generally coaxial with aperture 157 of indicator carrier 142. In an embodiment, telescopic sight 102 includes spindle 119 having a distal end operably connected to erector assembly 118 (see also FIG. 2; spindle 119 indicated in dashed lines inside body 108) and a proximal end projecting through the aperture defined by turret base 140 and being operably connected to indicator carrier 142. In an embodiment, the proximal end of spindle 119 has an end that in a cross sectional view is complementary to splined aperture 157, such that the spindle and carrier are tightly coupled. The spindle may be generally aligned along Axis A, as indicated in FIG. 2.

When initially assembled, indicator carrier 142 is positioned onto the proximal end of spindle 119 such that the "zero" MOA label or indicium of angular position indicia 164 is positioned adjacent zero indicator 200, which may also be referred to as zero mark, or zero-point indicator 200. Zero indicator 200 may be located on cylindrical body 108 or on turret base 140. Indicator pins 144 may be placed into channels 160 of indicator carrier 142 as described above. Gripping cap 146 is fastened onto carrier 142.

In general operation, rotation of gripping cap 146 causes rotation of indicator carrier 142, which consequently turns spindle 119, which causes erector assembly to adjust reticle cell 120 upwardly or downwardly within cylindrical body 108.

The rotation of an elevation turret operably coupled to an erector assembly via a spindle to cause a reticle to be adjusted is well-known in the art. Examples of apparatuses and methods relating to elevation adjustment turrets include: U.S. Pat. No. 3,990,155 issued Nov. 9, 1976, and entitled RIFLE-SCOPE ELEVATION ADJUSTMENT ASSEMBLY; U.S. Pat. No. 5,715,607, issued Feb. 10, 1998, and entitled TELESCOPIC SIGHT; U.S. Pat. No. 8,286,383, issued Oct. 16, 2012, and entitled RIFLE SCOPE AND ALIGNING DEVICE; and US Pat. Pub. US 2008/0289239, published Nov. 27, 2008, and entitled ACTUATOR FOR SETTING AT LEAST ONE OPTICAL PROPERTY, all of which are incorporated by reference herein in their entireties.

An embodiment of the claimed invention also includes a method of calibrating or initializing multiple-zero-point elevation turret 104. At a first step, indicator carrier 142 is placed onto spindle 119 with the "zero" indicium of angular position indicia 164 aligned with zero indicator 200 on cylindrical tube 108 (or turret base 140). The firearm is then sighted in for a predetermined distance by incrementally rotating indicator carrier 142 until the adjustment results in the fired projectile strikes the intended target when the reticle is placed over an image of the target as seen through the ocular. At this point, the zero MOA label or zero indicium is likely no longer aligned with zero indicator 200.

Indicator carrier 142 is then removed from spindle 119 and turret base 140, rotated such that the zero indicium on carrier 142 is aligned with zero indicator 200, and then is placed back onto spindle 119 and into base 140. At that particular adjustment position, the firearm is sighted in for that particular predetermined distance. A first indicator pin may then be placed into a channel 160 corresponding to the zero MOA label or indicium on the top surface of carrier 142. For example, a first indicator pin may be placed at the zero MOA label for a predetermined distance of 100 yards, or 200 yards. Typically the first indicator pin corresponds to a minimum predetermined distance. The position of the first pin 144 aligned to the zero indicium of indicia 164 may be considered a first "zero point".

In an embodiment, each indicator pin 144 may be colored, and each pin may have a unique color corresponding to one of a plurality of predetermined distances. In this manner, each pin corresponds to one predetermined distance. Further, additional pins 144 are inserted into additional channels 160, indicating additional distances, and thusly creating additional zero points, one for each distance, hence forming a "multiple-zero-point" elevation turret.

In an embodiment, the appropriate channel 160 for each additional pin 144 for a predetermined distance may be determined by trial and error, e.g., by firing and adjusting the rotational position.

In another embodiment, a ballistics calculation system associated with aiming reference system 106 may be used to determine proper pin 144 placement about carrier 142, thereby avoiding the trial-and-error method described briefly above. As understood by those skilled in the art, a number of factors affect the path of travel of a projectile fired from a firearm, including distance, firearm characteristics, projectile characteristics, and so on.

In an embodiment, a ballistics calculation system of the claimed invention includes an interface device, such as a client computer, smart phone, or other device that is connected to a local or remote server or other such computing device that includes a processor. Received data may include ballistics data such as ammunition data, firearm data, and so on, and in some embodiments may also include environmental data, firearm identification data, and so on. The processor receives the data from the user, and in some cases from stored data in a database accessible to the processor and related to the user-inputted data. The processor determines an elevation adjustment, which may be measured in angular position adjustments or measurements such as MOA, based on the received and stored data, and for a predetermined or received distance. The elevation adjustment is correlated to an angular position and an indicator pin 144 placement on indicator carrier 142. The placement being identified by angular position indicia 164, or the MOA labels, on surface 150 of carrier 142.

The processor may comprise a portion of a ballistics calculator that not only determines pin placement, but also matches pin colors to predetermined, desired distances. For example, a ballistics calculator of the present invention may receive ballistics data and desired distances from a user through the electronic interface, then transmit or display data to the user that includes pin color and placement for each desired target distance. Placement on indicator carrier 142 may be defined by one of indicia 164, which in turn corresponds to a pin channel 160. As will be described in greater detail below, such transmitted data may be printed onto a reference disc for installation onto telescopic sight 102 for easy viewing by the user.

Further, the ballistics calculator may also calculate a wind hold value for each of the predetermined target distances, and based upon received ballistics and possibly other data. As also described below in greater detail, such wind hold values may also be printed or otherwise displayed to a user.

Figure 11:
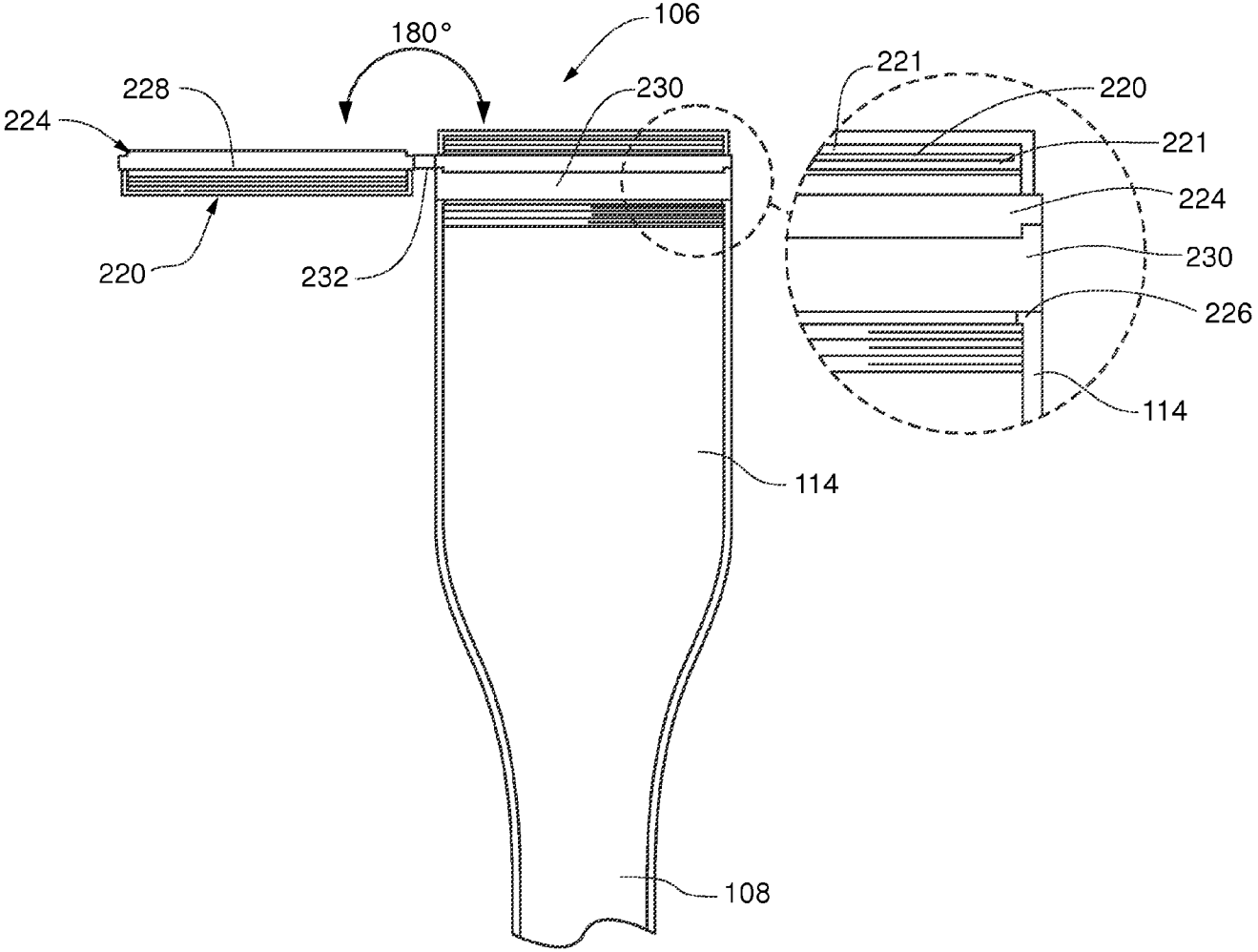
FIG. 11 is a top view of an aiming reference system, according to an embodiment of the claimed invention.
Figure 12:
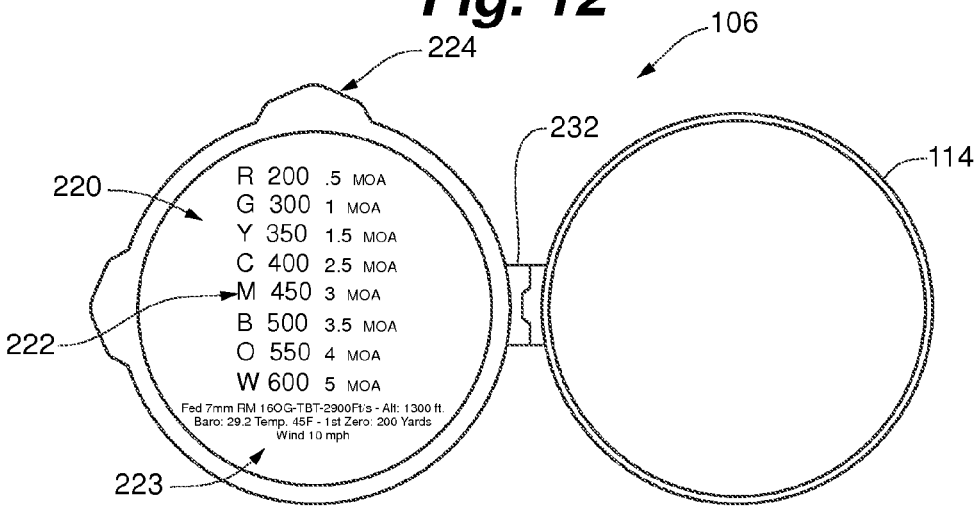
FIG. 12 is a front view of the aiming reference system of FIG. 12.
Figure 13:
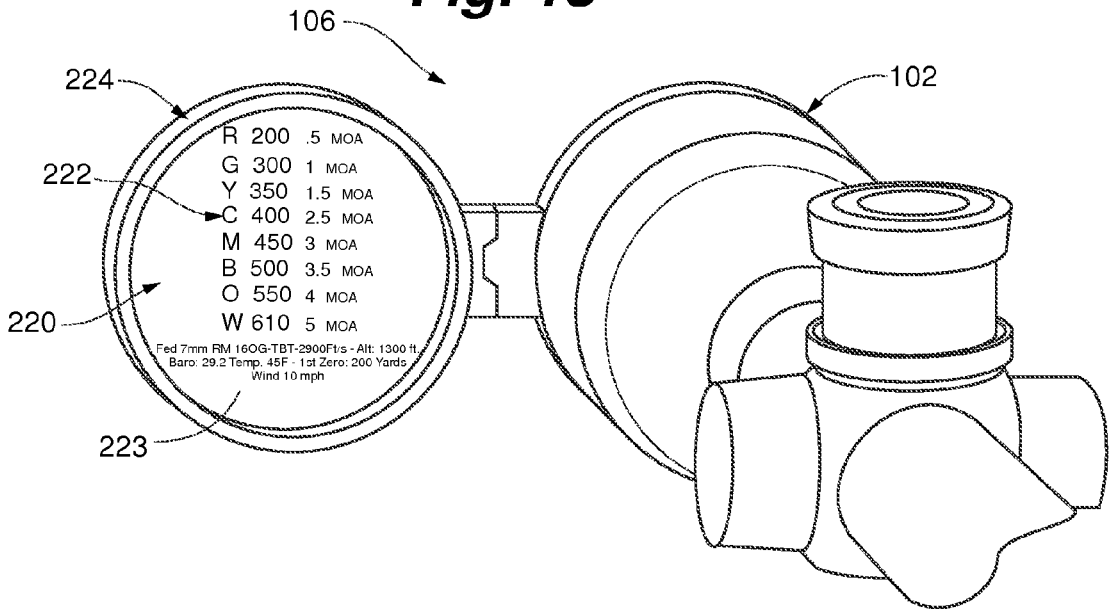
FIG. 13 is a front perspective view of the aiming reference system of FIG. 11.

Referring to FIGS. 11-13, an embodiment of aiming reference system 106 is depicted. In an embodiment, reference system 106 comprises reference disc 220, reference or ballistics data indicia 222, lens cover 224, optional o-ring 226, and objective housing or bell 114.

In an embodiment, reference disc 220, which in an embodiment is a printed ballistics disc, is protected by one or more clear plastic discs 221 and bears ballistics data indicia 222. Lens cover 224 may comprise a two-ring structure, first ring 228 coupled to second ring 230 via hinge 232. First ring 228 may house reference disc 220; second ring 230 may attached to a portion of objective housing 114, such that lens cover 224 with reference disc 220 is pivotally attached to objective housing 114.

In a closed position, lens cover 224 covers an end of objective housing 114 and the objective lens, such that ballistics data indicia 222 is generally out of view of a user of the scope, and the objective lens is protected. In an open position, as depicted, reference disc 220 is pivoted at hinge 232 away from objective housing 114 such that ballistics data indicia 222 is easily viewable to a user of telescopic sight 102.

In alternate embodiments, reference disc 220 may comprise other structures that may be attached to objective housing 114, to cylinder body 108, or to other portions of sight 102, provided that ballistics data indicia is conveniently viewed by a user of sight 102.

Ballistics data indicia 222 may indicate a wide variety of ballistics data. In an embodiment, ballistics data includes ballistic data sets, each set comprising a distance and a distance key, such as a color key. The distance key, or color, corresponds to a matching color of one of indicator pins 144 of multiple-zero-point elevation turret 104 and angular position indicia 164. Further, data associated with a particular data set may all be displayed in the unique color corresponding to the determined indicator pin color.

Each data set may also include wind hold information. Wind hold information may be displayed in MOA increments that correspond to MOA indicia of a reticle of telescoping sight 102, as described below with respect to FIG. 14. As such, a user may choose to adjust the wind hold via windage adjustment turret 124, such that the reticle crosshairs or dot is centered on the target, or alternatively, may leave the windage turret zeroed, and more quickly move the relative reticle center off target to account for wind.

Further, ballistics data 222 may also include additional data 223 such as load data; projectile velocity; altitude, pressure and temperature basis; wind assumptions/basis for wind hold data (e.g., 10 mph); firearm data; scope or firearm identification data; and so on. In the embodiment depicted, the additional data comprises load data; projectile velocity; altitude basis; pressure basis; temperature basis; first zero-point distance; wind assumptions/basis for wind hold data (e.g., 10 mph); firearm data; which in the depicted embodiment respectively comprises: Fed 7 mm RM 160 G TBT; 2900 Ft/s; 1300 ft; 29.2 Atmospheres; 45° F.; $1^{st}$ Zero: 200 Yds; and wind 10 mph.

Referring to FIG. 14, an example reticle 122 utilized in an embodiment of telescopic sight 102 is depicted. Generally speaking, the intersection of crosshairs or the dot located in the center of the reticle represents the optical center, or point of aim. Furthermore, most riflescopes, including telescopic sight 102, provide variable levels of magnification in order to allow a user to zoom in on targets at various distances.

As described above, when shooting at long distances, shooters must adjust their aim to take into account the downward acceleration on the projectile imparted by gravity, which is often referred to as "bullet drop." This is typically done by adjusting the angular position of the riflescope relative to the rifle barrel using an elevation turret, in manner described above. Furthermore, shooters must adjust their aim to take into account lateral acceleration on the projectile imparted by wind, which is often referred to as "windage." Riflescope aiming system 100 not only includes multiple-zero-point elevation turret 104 to control the vertical elevation of the reticle, but may also include systems and information for determining a wind hold adjustment to control the lateral adjustment of the reticle.

Reticle 122, according to an embodiment of the invention is depicted. Reticle 122 includes horizontal and vertical posts 242 and collinear primary horizontal and vertical lines 244, the hypothetical intersection of which is the optical center 246. Reticle 122 is scaled to include various indicia to indicate distance, which is represented on the reticle in terms of minutes of angle, or MOA, or other such measurement indicia. In other words, the measurement of a given MOA on the reticle indicates the elevation or windage adjustment (depending on whether the measurement is vertical or horizontal) required on the riflescope via windage adjustment turret 124, or via movement of the telescopic sight so as to adjust the placement of optical center 246 relative to the target.

Reticle 122 provides various tools for measuring distance. With respect to reticle 122, according to this particular example embodiment, the posts 242 have thickness 242', which corresponds to 0.7 MOA; the primary lines 244 have thickness 244', which corresponds to 0.2 MOA; and the optical center dot 246 has diameter 246', which corresponds to 0.5 MOA. Furthermore, the horizontal primary lines 44 include a plurality of major tick marks or stadia 248 and minor tick marks 250, which have a scaled height and width of 248"× 248' and 250"×250', respectively, which on this particular example reticle 122 correspond to 0.2 MOA×0.1 MOA and 0.2 MOA×0.5 MOA, respectively. The MOA measurements taken from the reticle 122 can be very helpful with respect to determining minor manual elevation and windage adjustments; however, these measurements require visual estimation and may be best suited for small fine-tuning adjustments.

Figure 15:
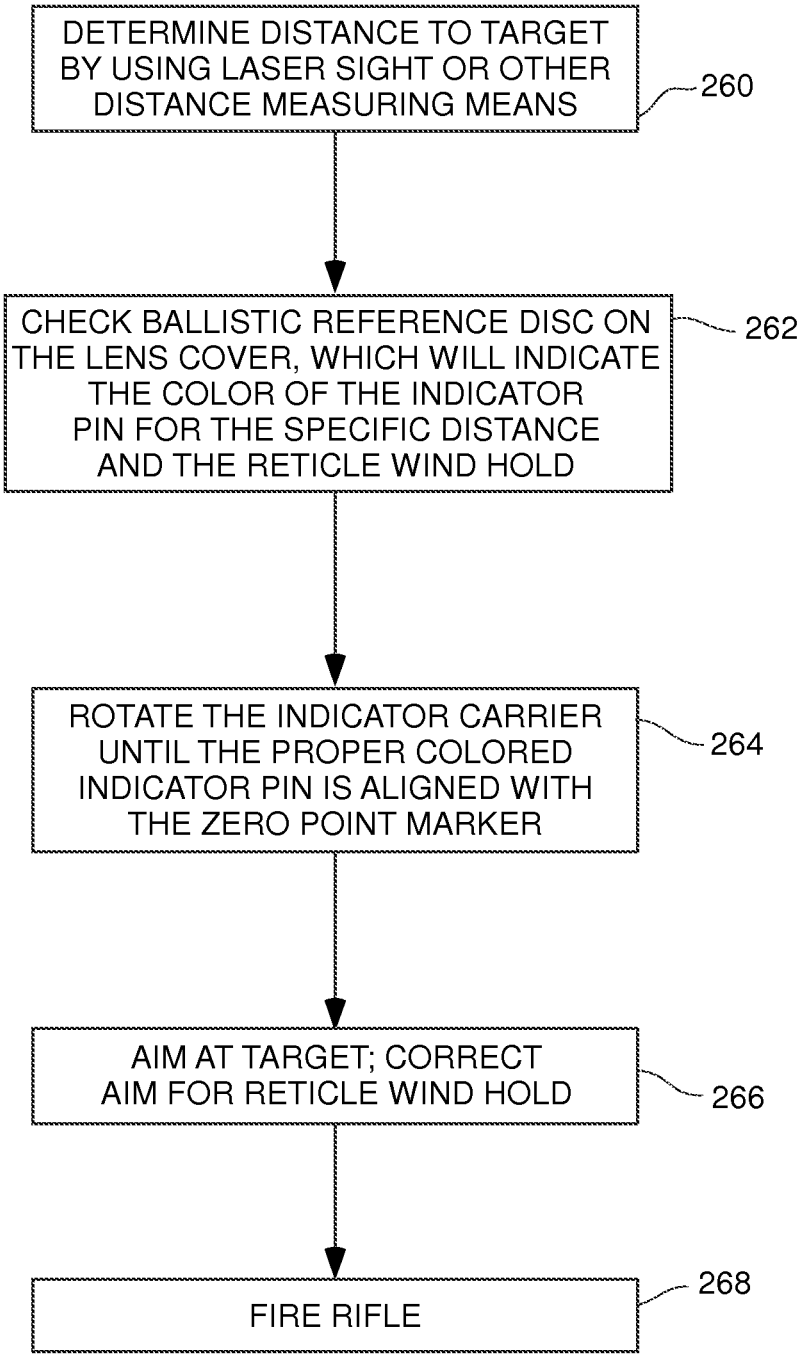
FIG. 15 is a flow diagram of a process of using the riflescope aiming system of FIG. 1, according to an embodiment of the claimed invention.

Referring to FIG. 15, in an embodiment, the claimed invention includes a method of using system 100. At step 260, a shooter estimates a distance to a target, or determines a distance to the target by using a laser sight or other distance measuring means. Next, at step 262, the shooter checks the ballistic reference disc on the lens cover, quickly matching the estimated distance to an indicator pin color and noting a reticle wind hold. At step 264, the shooter rotates indicator carrier 142 until the colored indicator pin corresponding to the distance is aligned with zero indicator 200 on telescopic sight 102. At step 266, the shooter aims, correcting for the reticle wind hold. At step 268, the shooter fires his rifle at the target.

Consequently, embodiments of the claimed invention include, but are not limited to, a riflescope aiming system, a multiple-zero-point elevation turret for a riflescope, an aiming reference system for a riflescope, an indexed reticle pattern for a riflescope and a method of aiming a riflescope having a multiple-zero-point elevation turret.

In an embodiment, the claimed invention comprises a riflescope aiming system that includes: a telescopic sight including a cylindrical body having an ocular housing carrying an ocular lens system at a first end and an objective housing carrying an objective lens system at a second end, and housing an erector assembly having an erector tube and a reticle; a multiple-zero-point elevation turret mounted to the cylindrical body and operably coupled to the erector assembly, the multiple-zero-point elevation turret including a rotatable indicator carrier and a plurality of indicator pins secured to the indicator carrier, each indicator pin corresponding to a predetermined target distance, the adjustable indicator carrier coupled to the erector assembly such that a rotation of the indicator carrier causes a reticle position to be adjusted; an aiming reference system operably coupled to the objective housing and displaying aiming reference data, the aiming reference data including a target distance and an indicator pin identifier identifying the one of the plurality of indicator pins corresponding to the target distance.

An embodiment of a multiple-zero-point elevation turret for a riflescope comprises: an indicator carrier configured to be rotatably coupled to the riflescope, the indicator carrier defining a plurality of axially extending indicator-pin channels distributed about a circumference of the indicator carrier; and a plurality of indicator pins, each indicator pin corresponding to a predetermined target distance and including a key portion and a visual index portion, each key portion being received by an indicator pin channel such that the indicator pin is secured to the indicator carrier, and the visual index portion presents an index surface. The alignment of the indicator pin with a stationary zero-index mark indicates that the riflescope aiming is adjusted to correspond to the predetermined target distance.

An embodiment of an aiming reference system for a riflescope comprises: a reference disc operably coupled to the riflescope and movable between a first position and a second position; reference data indicia displayed on a surface of the reference disc, the reference data including a plurality of distance indicia, the distance indicia indicating a target distance and a unique identifier corresponding to a zero-point setting of an elevation turret. The reference data indicia are viewable in the first position.

An embodiment of an indexed reticle pattern for a riflescope comprises: a scaled horizontal cross hair having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); and a scaled vertical cross hair intersecting the scaled horizontal cross hair and having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA). The stadia markings provide a reference index for adjusting an optical center of the riflescope.

An embodiment of a method of aiming a riflescope having a multiple-zero-point elevation turret comprises: estimating a distance to a target; viewing a ballistics reference disc coupled to the riflescope, including viewing a plurality of reference distances and a plurality of unique identifiers associated with the plurality of references distances; matching the estimated distance to the target to one of the plurality of reference distances and a unique identifier associated with the reference distance; adjusting a setting of the multiple-zero-point elevation turret based on the unique identifier; and viewing the target through the riflescope.

An embodiment of the invention comprises a riflescope aiming system, comprising: a telescopic sight including a cylindrical body having an ocular housing carrying an ocular lens system at a first end and an objective housing carrying an objective lens system at a second end, and housing an erector assembly having an erector tube and a reticle; a multiple-zero-point elevation turret mounted to the cylindrical body and operably coupled to the erector assembly, the multiple-zero-point elevation turret including a rotatable indicator carrier and a plurality of indicator pins secured to the indicator carrier, each indicator pin corresponding to a predetermined target distance, the adjustable indicator carrier coupled to the erector assembly such that a rotation of the indicator carrier causes a reticle position to be adjusted; an aiming reference system operably coupled to the objective housing and displaying aiming reference data, the aiming reference data including a target distance and an indicator pin identifier identifying the one of the plurality of indicator pins corresponding to the target distance.

In an embodiment, the indicator pin identifier comprises a color unique to the target distance.

In an embodiment, the aiming reference data further includes a reticle wind hold value corresponding to the target distance.

In an embodiment, the aiming reference system includes a reference disc incorporated into a lens cover, the reference disc bearing sets of printed, color-coded aiming reference data.

In an embodiment, the invention comprises a multiple-zero-point elevation turret for a riflescope, comprising: an indicator carrier configured to be rotatably coupled to the riflescope, the indicator carrier defining a plurality of axially extending indicator-pin channels distributed about a circumference of the indicator carrier; and a plurality of indicator pins, each indicator pin corresponding to a predetermined target distance and including a key portion and a visual index portion, each key portion being received by an indicator pin channel such that the indicator pin is secured to the indicator carrier, and the visual index portion presents an index surface; wherein the alignment of the indicator pin with a stationary zero-index mark indicates that the riflescope aiming is adjusted to correspond to the predetermined target distance.

In an embodiment, each indicator pin is associated with a unique color indicating the predetermined target distance.

In an embodiment, the indicator pin comprises an inverted "J" shape.

In an embodiment, a portion of the indicator pins arcs inward toward a center of the indicator carrier.

In an embodiment, the multiple-zero-point elevation turret for a riflescope further comprises a gripping cap that exerts a holding force on the plurality of indicator pins.

In an embodiment, the plurality of indicator pins comprises 8 indicator pins, each having a unique color.

In an embodiment, the invention comprises an aiming reference system for a riflescope, comprising: a reference disc operably coupled to the riflescope and movable between a first position and a second position; reference data indicia displayed on a surface of the reference disc, the reference data including a plurality of distance indicia, the distance indicia indicating a target distance and a unique identifier corresponding to a zero-point setting of an elevation turret; wherein the reference data indicia are viewable in the first position.

In an embodiment, the reference disc is carried by a lens cover operably coupled to an objective housing of the riflescope.

In an embodiment, the unique identifier is a unique color.

In an embodiment, the reference data further comprises wind hold data.

In an embodiment, the reference data comprises ballistics data.

In an embodiment, the aiming reference system further comprises a ballistics calculator that receives ballistics data, and transmits reference data, including the unique identifier.

In an embodiment, the invention comprises an indexed reticle pattern for a riflescope, comprising: a scaled horizontal cross hair having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); and a scaled vertical cross hair intersecting the scaled horizontal cross hair and having a plurality of evenly spaced stadia markings, the cross hair having a known, uniform width defined in minutes of angle (MOA), each stadia marking having a known, uniform width and height, and a distance between stadia markings being uniform, each of the width, height, and distance measured in minutes of angle (MOA); wherein the stadia markings provide a reference index for adjusting an optical center of the riflescope.

In an embodiment, the adjustment of the optical center includes one or both of an elevation adjustment and a windage adjustment.

In an embodiment, the invention comprises a method of aiming a riflescope having a multiple-zero-point elevation turret, comprising: estimating a distance to a target; viewing a ballistics reference disc coupled to the riflescope, including viewing a plurality of reference distances and a plurality of unique identifiers associated with the plurality of references distances; matching the estimated distance to the target to one of the plurality of reference distances and a unique identifier associated with the reference distance; adjusting a setting of the multiple-zero-point elevation turret based on the unique identifier; and viewing the target through the riflescope.

In an embodiment, the unique identifier is a color associated with the reference distance, and adjusting a setting of the multiple-zero-point elevation turret based on the unique identifier comprises rotating a portion of the turret to align an indicator pin having a color matching the unique identifier color with a zero-point mark.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A riflescope aiming system, comprising:

a telescopic sight including a cylindrical body having an ocular housing carrying an ocular lens system at a first end and an objective housing carrying an objective lens system at a second end, and housing an erector assembly having an erector tube and a reticle;

a multiple-zero-point elevation turret mounted to the cylindrical body and operably coupled to the erector assembly, the multiple-zero-point elevation turret including a rotatable indicator carrier and a plurality of indicator pins secured to the indicator carrier, each indicator pin corresponding to a predetermined target distance, the adjustable indicator carrier coupled to the erector assembly such that a rotation of the indicator carrier causes a reticle position to be adjusted;

an aiming reference system operably coupled to the objective housing and displaying aiming reference data, the aiming reference data including a target distance and an indicator pin identifier identifying the one of the plurality of indicator pins corresponding to the target distance;

wherein the aiming reference system includes a reference disc incorporated into a lens cover, the reference disc bearing at least one set of printed, color-coded aiming reference data.

2. The riflescope aiming system of claim 1, wherein the indicator pin identifier comprises a color unique to the target distance.

3. The riflescope aiming system of claim 1, wherein the aiming reference data further includes a reticle wind hold value corresponding to the target distance.

4. A multiple-zero-point elevation turret for a riflescope, comprising:

an indicator carrier configured to be rotatably coupled to the riflescope, the indicator carrier defining a plurality of axially extending indicator-pin channels distributed about a circumference of the indicator carrier; and a plurality of indicator pins, each indicator pin corresponding to a predetermined target distance and including a key portion and a visual index portion, each key portion being received by an indicator pin channel such that the indicator pin is secured to the indicator carrier, and the visual index portion presents an index surface, the plurality of indicator pins comprising eight indicator pins, each indicator pin having a unique color;

wherein the alignment of the indicator pin with a stationary zero-index mark indicates that the riflescope aiming is adjusted to correspond to the predetermined target distance.

5. The multiple-zero-point elevation turret of claim 4, wherein each indicator pin is associated with a unique color indicating the predetermined target distance.

6. The multiple-zero-point elevation turret of claim 4, wherein the indicator pin comprises an inverted "J" shape.

7. The multiple-zero-point elevation turret of claim 6, wherein a portion of the indicator pins arcs inward toward a center of the indicator carrier.

8. The multiple-zero-point elevation turret of claim 4, further comprising a gripping cap that exerts a holding force on the plurality of indicator pins.

9. An aiming reference system for a riflescope, comprising:

a reference disc operably coupled to the riflescope and movable between a first position and a second position;

reference data indicia indicating reference data, the reference data indicia displayed on a surface of the reference disc, the reference data indicia viewable in the first position and including a plurality of distance indicia, the distance indicia indicating a target distance and a unique identifier corresponding to a zero-point setting of an elevation turret; and a ballistics calculator that receives ballistics data, and transmits reference data, including the unique identifier.

10. The aiming reference system of claim 9, wherein the reference disc is carried by a lens cover operably coupled to an objective housing of the riflescope.

11. The aiming reference system of claim 9, wherein the unique identifier is a unique color.

12. The aiming reference system of claim 9, wherein the reference data-comprises wind hold data.

13. The aiming reference system of claim 9, wherein the reference data comprises ballistics data.

14. An aiming reference system for a riflescope, comprising:

a reference disc operably coupled to the riflescope and movable between a first position and a second position;

reference data indicia indicating reference data that includes ballistics data, the reference data indicia displayed on a surface of the reference disc, the reference data indicia including a plurality of distance indicia, the distance indicia indicating a target distance and a unique identifier corresponding to a zero-point setting of an elevation turret;

wherein the reference data indicia are viewable in the first position.

15. The aiming reference system of claim 14, wherein the reference disc is carried by a lens cover operably coupled to an objective housing of the riflescope.

16. The aiming reference system of claim 14, wherein the unique identifier is a unique color.

17. The aiming reference system of claim 14, wherein the reference data further comprises wind hold data.

18. The aiming reference system of claim 14, further comprising a ballistics calculator that receives the ballistics data, and transmits the reference data, including the unique identifier.

* * * * *